US008758054B2

(12) United States Patent
Miyawaki et al.

(10) Patent No.: US 8,758,054 B2
(45) Date of Patent: Jun. 24, 2014

(54) TERMINAL FITTING

(71) Applicant: Yazaki Corporation, Tokyo (JP)

(72) Inventors: Koji Miyawaki, Susono (JP); Hidenori Kanda, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/777,481

(22) Filed: Feb. 26, 2013

(65) Prior Publication Data

US 2013/0224996 A1 Aug. 29, 2013

(30) Foreign Application Priority Data

Feb. 29, 2012 (JP) ..... 2012-044547

(51) Int. Cl.
*H01R 9/05* (2006.01)
*H01R 4/18* (2006.01)

(52) U.S. Cl.
CPC ..... *H01R 9/0518* (2013.01); *H01R 4/185* (2013.01)
USPC ..... 439/585

(58) Field of Classification Search
USPC ..... 439/585, 877, 878, 882
See application file for complete search history.

(56) References Cited

U.S. PATENT DOCUMENTS 6,482,034 B2 * 11/2002 Ozaki ..... 439/585
7,497,730 B2 * 3/2009 Kobayashi et al. ..... 439/585
8,052,466 B2 * 11/2011 Okamoto ..... 439/585

FOREIGN PATENT DOCUMENTS

JP 2011-210443 A 10/2011

* cited by examiner

*Primary Examiner* — Neil Abrams
*Assistant Examiner* — Travis Chambers
(74) *Attorney, Agent, or Firm* — Sughrue Mion, PLLC

(57) ABSTRACT

In a terminal fitting, round hole type serration parts which include round holes are formed for an insulating outer cover bottom plate part and for a braided wire bottom plate part and round hole type serration parts which include round holes are formed for any one of one pair of insulating outer cover crimp strips and for any one of one pair of braided wire crimp strips to strengthen biting of a coaxial wire.

1 Claim, 6 Drawing Sheets

TERMINAL FITTING

BACKGROUND OF THE INVENTION

1. Field of the Invention

The present invention relates to a terminal fitting to which a terminal of a coaxial wire is to be connected, and more particularly to a terminal fitting capable of being connected to the coaxial wire with large holding strength.

2. Related Background of the Invention

In a terminal fitting to be connected to a coaxial wire, strong connection to the coaxial wire becomes possible by increasing the holding strength of a crimp part to be crimped to a braided wire and an insulating outer cover of the coaxial wire. A terminal fitting having a structure in which the holding strength of the crimp part is increased is disclosed in Patent Document 1. FIG. 10 and FIG. 11 illustrate an existing terminal fitting 100 disclosed in Patent Document 1.

As illustrated in FIG. 10, the terminal fitting 100 is connected to a terminal of a coaxial wire 200 whose insulating outer cover 230 is peeled. The coaxial wire 200 has a structure in which a core wire (not illustrated) is covered with an insulating inner cover 210, the insulating inner cover 210 is covered with a braided wire 220 and the braided wire 220 is covered with the insulating outer cover 230. The terminal fitting 100 is formed including a body part 110 and a crimp part 120. The body part 110 has a shape of cylinder into which an inner housing (not illustrated) in which the core wire of the coaxial wire 200 is contained is to be inserted and the crimp part 120 is to be crimped to the braided wire 220 and the insulating outer cover 230.

FIG. 11 illustrates a state where the terminal fitting 100 in FIG. 10 is developed. The crimp part 120 of the terminal fitting 100 is formed by a braided wire crimp part 130 to be crimped to the braided wire 220 and an insulating outer cover crimp part 140 to be crimped to the insulating outer cover 230 as illustrated in FIG. 11. The braided wire crimp part 130 is formed by a bottom part 131 and one pair of braided wire crimp strips 133 and 135 extended on the both sides of the bottom part 131. The insulating outer cover crimp part 140 is formed by a bottom part 141 which is continuous with the bottom part 131 of the braided wire crimp part 130 and one pair of insulating outer cover crimp strips 143 and 145 extended on the both sides of the bottom part 141. The braided wire crimp strips 133 and 135 and the insulating outer cover crimp strips 143 and 145 are bent from the respective bottom parts 131 and 141 to form a U-shape and used for crimping to the coaxial wire.

In the terminal fitting 100 of Patent Document 1, knurling is performed on surfaces of the braided wire crimp part 130 and the insulating outer cover crimp part 140 which face the coaxial wire 200 to form serration parts on the surfaces. In the braided wire crimp part 130, a first serration part 131*a* is formed on the bottom part 131 and second serration parts 133*a* and 135*a* are respectively formed on the pair of braided wire crimp strips 133 and 135 as illustrated in FIG. 11. In the insulating outer cover crimp part 140, although knurling is not performed on the bottom part 141, a third serration part 143*a* is formed on the one insulating outer cover crimp strip 143 and a fourth serration part 145*a* is formed on the other insulating outer cover crimp strip 145. These serration parts 131*a*, 133*a* and 135*a*, and 143*a* and 145*a* are formed by knurling and formed into rectangular concave portions.

In such the terminal fitting 100, the crimp strips 133 and 135, and 143 and 145 are swaged in a state where the peeled and exposed braided wire 220 of the coaxial wire 200 is situated on the braided wire crimp part 130 and the insulating outer cover 230 of the coaxial wire 200 is situated on the insulating outer cover crimp part 140, and thereby the braided wire crimp strips 133 and 135 are crimped in an overlapping state and the insulating outer cover crimp strips 143 and 145 are crimped in an overlapping state. In the crimping, the serration parts 133*a* and 135*a* on the braided wire crimp strips 133 and 135 of the braided wire crimp part 130 bite into side face parts of the braided wire 220 of the coaxial wire 200 and the serration parts 143*a* and 145*a* on the insulating outer cover crimp strips 143 and 145 of the insulating outer cover crimp part 140 bite into the insulating outer cover 230 of the coaxial wire 200. Thus, the terminal fitting 100 is connected to the coaxial wire 200 while holding the coaxial wire 200.

PRIOR ART DOCUMENT

Patent Document

[Patent Document 1] Japanese Patent Laid-Open No. 2011-210443

SUMMARY OF THE INVENTION

However, in the terminal fitting 100 described in Patent Document 1, because the serration parts 131*a*, 133*a*, 135*a*, 143*a* and 145*a* formed on the crimp part 120 are knurled, each serration part is formed into a rectangular concave portion recessed on the surface of the terminal fitting 100. In such the concave portions, even if the braided wire 220 and the insulating outer cover 230 bite into the concave portions in the serrations parts 131*a*, 133*a*, 135*a*, 143*a* and 145*a* by crimping, the fixing strength thereof is weak because edge parts are short. Therefore, such a disadvantage occurs that the strength of holding the coaxial wire 200 is weak.

In addition, in a state to be crimped to the coaxial wire 200, since the serration parts 133*a* and the 135*a* on the braided wire crimp strips 133 and 135, and the serration parts 143*a* and 145*a* on the insulating outer cover crimp strips 143 and 145 are situated on side face parts of the coaxial wire 200, such a disadvantage occurs that the crimp strips 133, 135, 143 and 145 are liable to buckle and defective crimping to the braided wire 220 and the insulating outer cover 230 occurs by the buckling, resulting in reduction in adhesion.

From the above, when the crimping strength of the braided wire crimp part 130 and the insulating outer cover crimp part 140 is increased in crimping, the core wire of the coaxial wire is compressed more than necessary and hence such a disadvantage occurs that the core wire is disconnected.

Therefore, the present invention aims to provide a terminal fitting free from defective crimping caused by buckling even when serration parts are formed and also free from disconnection of a core wire of a coaxial wire caused by crimping.

According to an aspect of the present invention, a terminal fitting to which a terminal of a coaxial wire that includes a core wire, a braided wire covering an outer periphery of the braided wire is to be connected, includes a body part to be connected to a mating terminal is formed integrally with a crimp part to which the coaxial wire is to be crimped in a state where the insulating outer cover is peeled, the crimp part is formed by an insulating outer cover crimp part to which the insulating outer cover is to be crimped and a braided wire crimp part to which the braided wire is to be crimped, the insulating outer cover crimp part is formed by an insulating outer cover bottom plate part and one pair of insulating outer cover crimp strips extended from the both sides of the insulating outer cover bottom plate part in the same direction, the braided wire crimp part is formed by a braided wire bottom plate part and one pair of braided wire crimp strips extended from the both sides of the braided wire bottom plate part in the same direction, round hole type serration parts which include round holes are formed for the insulating outer cover bottom plate part and for the braided wire bottom plate part, and round hole type serration parts which include round holes are formed for any one of the one pair of insulating outer cover crimp strips and for any one of the one pair of braided wire crimp strips.

The present invention is preferably the terminal fitting, in which the round hole type serration part is formed for one of the one pair of insulating outer cover crimp strips, the round hole type serration part is formed for the other of the one pair of braided wire crimp strips, and crimping is performed in a state where the one insulating outer cover crimp strip with the round hole type serration part formed is situated under the other insulating outer cover crimp strip and the other braided wire crimp strip with. The round hole type serration part is formed is situated under the one braided wire crimp strip.

DESCRIPTION OF THE PREFERRED EMBODIMENTS

Figure 1:
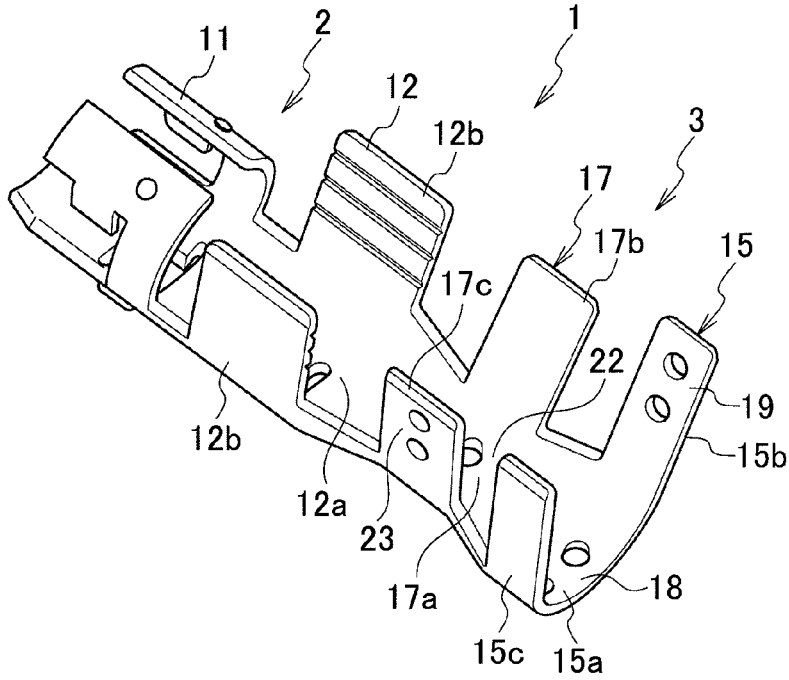
FIG. 1 is a perspective view illustrating a terminal fitting according to one embodiment of the present invention.
Figure 2:
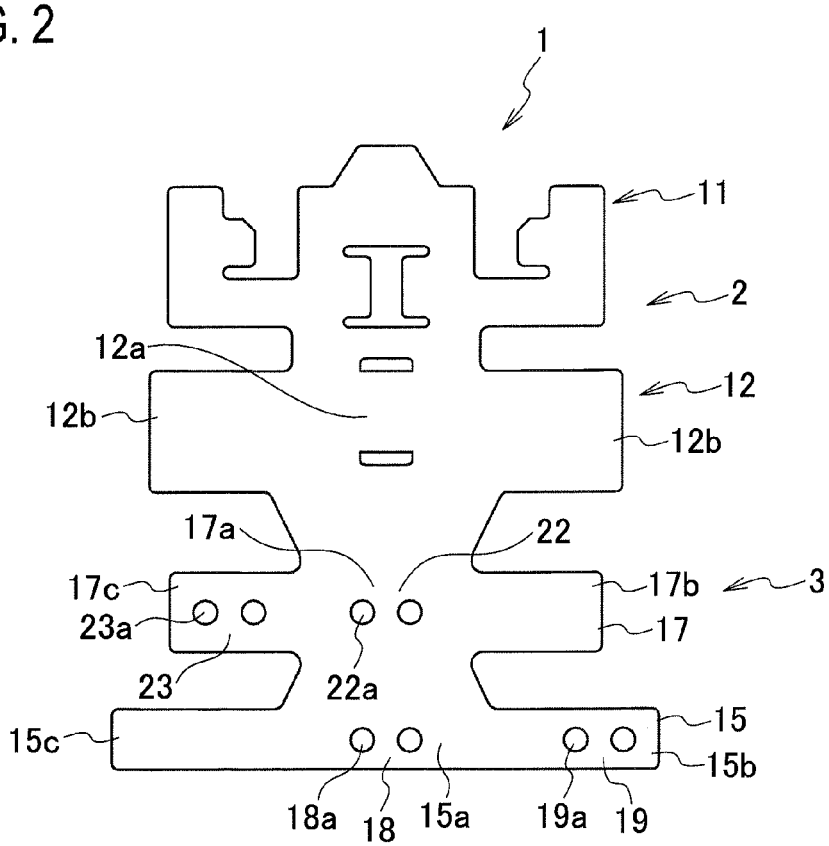
FIG. 2 is a plan view illustrating a development state of the terminal fitting according to one embodiment.
Figure 3:
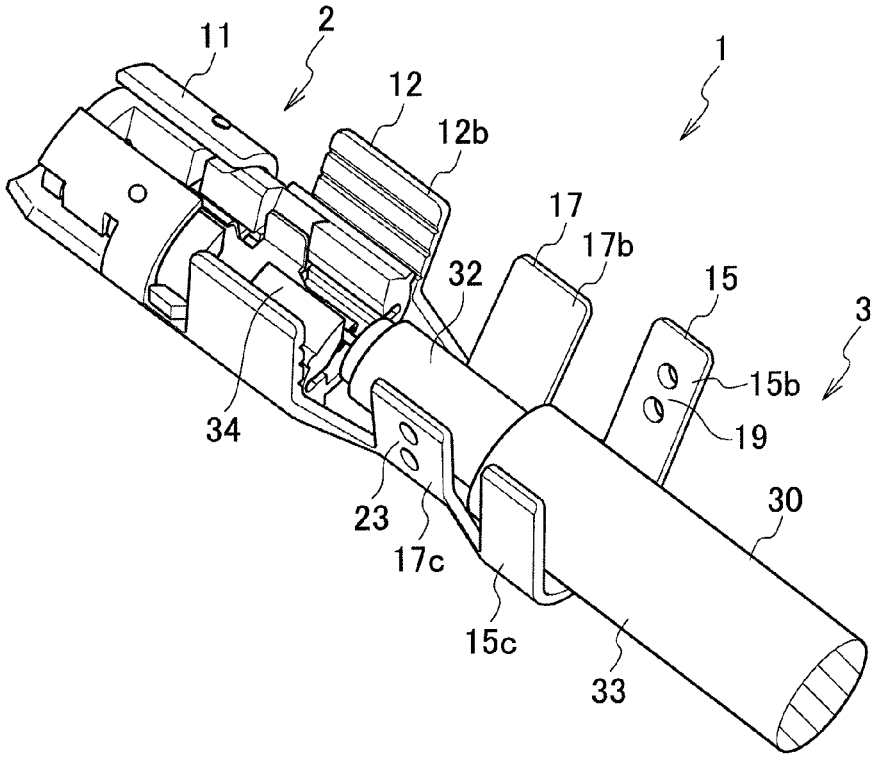
FIG. 3 is a perspective view illustrating a state before the terminal fitting is crimped to a coaxial wire.
Figure 4:
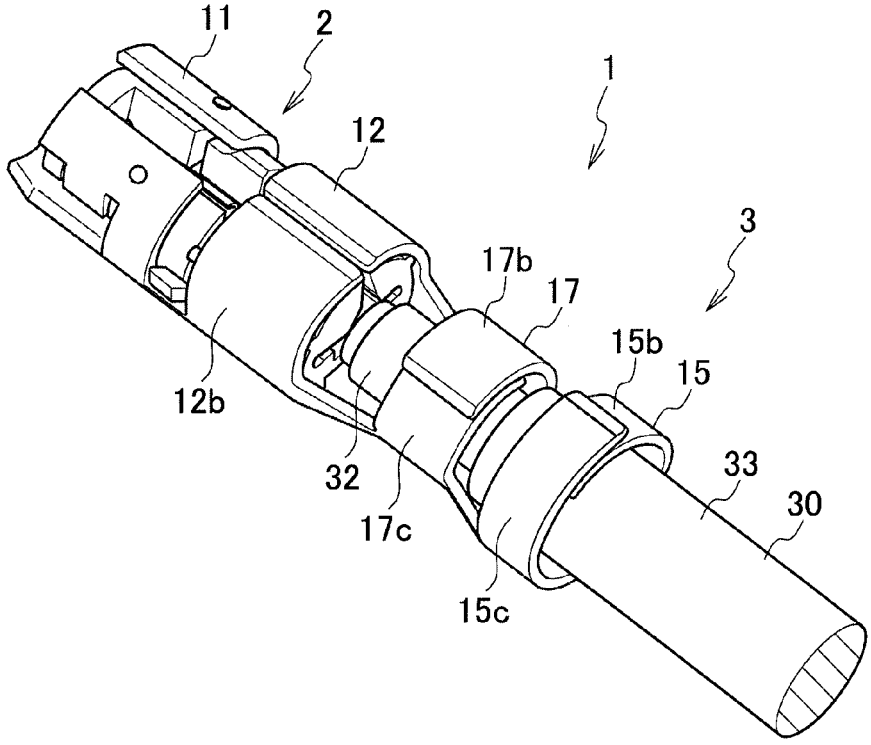
FIG. 4 is a perspective view illustrating a state of having crimped the terminal fitting to the coaxial wire.
Figure 5:
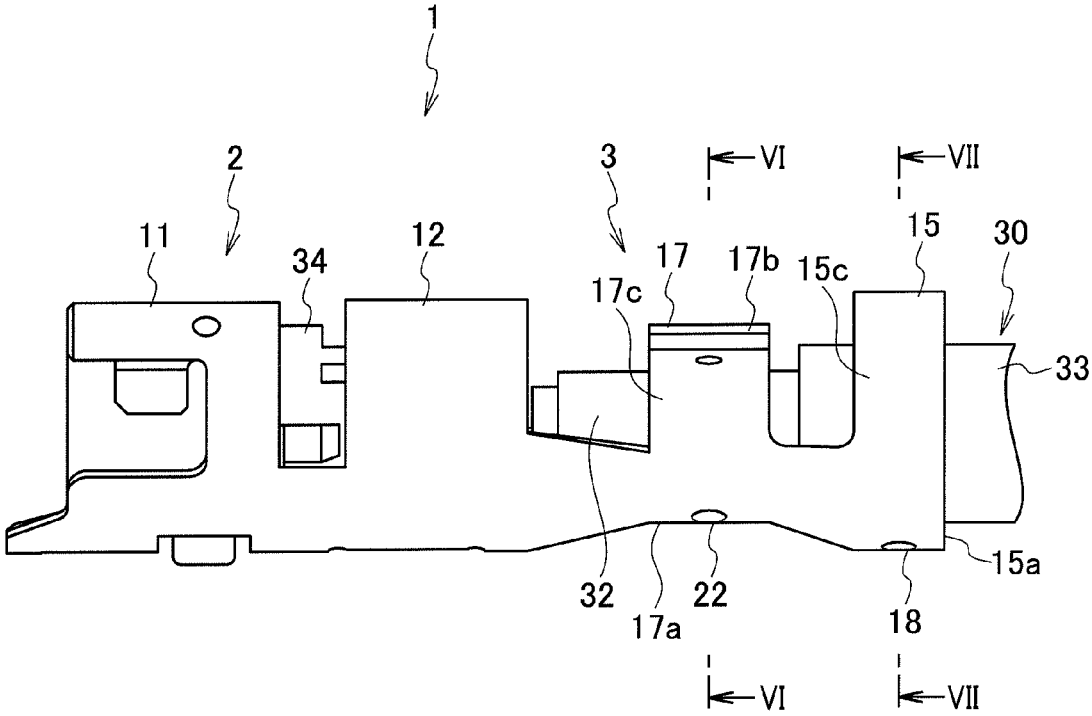
FIG. 5 is a side view illustrating the state of having crimped the terminal fitting to the coaxial wire.
Figure 6:
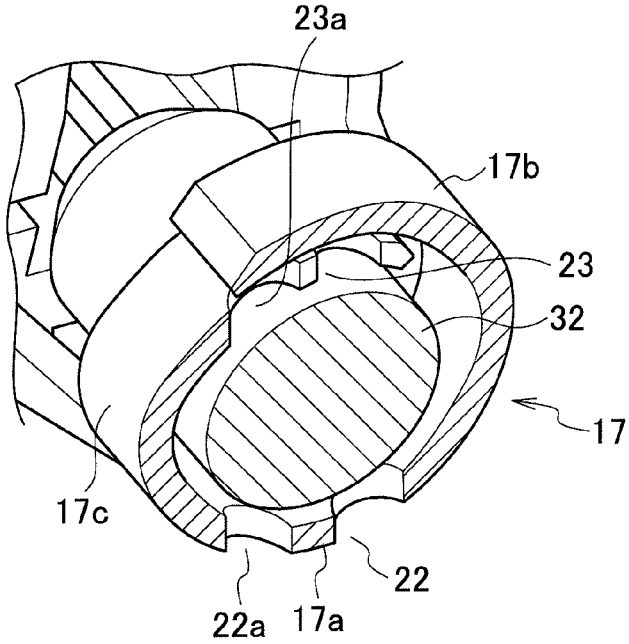
FIG. 6 is a sectional view taken along an VI-VI line in FIG. 5.
Figure 7:
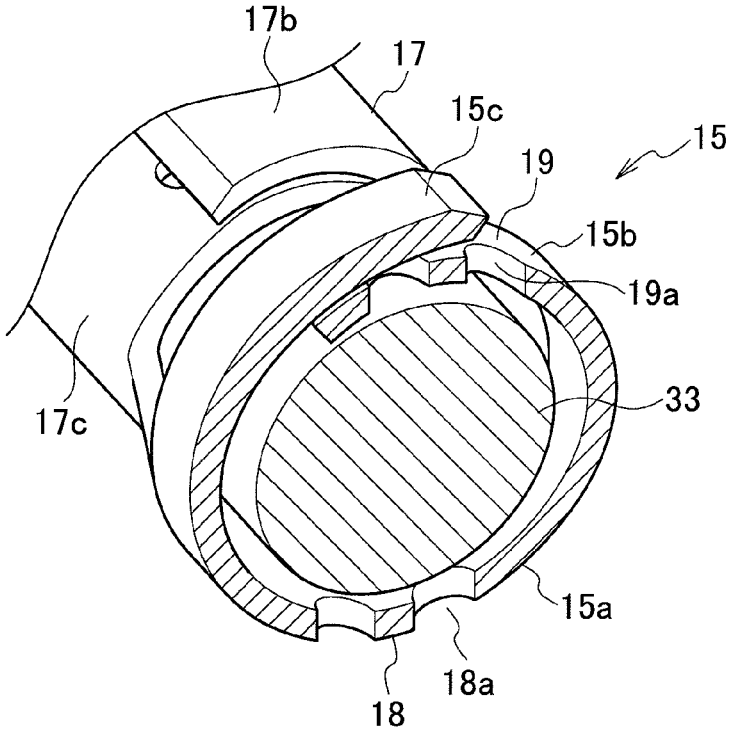
FIG. 7 is a sectional view taken along a VII-VII line in FIG. 5.

In the following, the present invention will be more specifically described using one embodiment illustrating the present invention. FIG. 1 is a perspective view of a terminal fitting 1 according to one embodiment of the present invention. FIG. 2 is a plan view of a development state thereof. FIG. 3 is a perspective view of a state before crimping to a coaxial wire. FIG. 4 is a perspective view of a state after the crimping to the coaxial wire. FIG. 5 is a side view illustrating the crimping state to the coaxial wire. FIG. 6 and FIG. 7 are sectional views respectively taken along an VI-VI line and a VII-VII line in FIG. 5.

As illustrated in FIG. 1 and FIG. 2, the terminal fitting 1 includes a body part 2 and a crimp part 3 which are integrally formed so as to extend from the body part 2 and the entire thereof is formed by an electrically conductive metal plate. The terminal fitting 1 is to be connected to a terminal of a coaxial wire 30.

As illustrated in FIG. 5, the coaxial wire 30 is formed by a core wire (not illustrated) formed by twisting together a plurality of electrically conductive element wires, an insulating inner cover (not illustrated) which is disposed to cover the outer periphery of the core wire and is made of an dielectric, an electrically conductive braided wire 32 which is disposed to cover the outer periphery of the insulating inner cover and an insulating outer cover 33 which is disposed to cover the outer periphery of the braided wire 32 and is made of an insulating resin. The braided wire 32 is formed by braiding electrically conductive metal element wires into the form of a net. The core wire and the insulating inner cover are contained in an inner housing 34 to be used for connection with the terminal fitting 1. In connection with the terminal fitting 1, the core wire is connected to an inner terminal (not illustrated), the inner terminal is contained in the inner housing 34 and then the inner housing 34 is fixed to the body part 2 of the terminal fitting 1.

An inner housing containing cylinder part 11 is formed at a leading end part of the body part 2 of the terminal fitting 1 in a length-wise direction and an inner housing crimp part 12 is formed behind the inner housing containing cylinder part 11. The inner housing crimp part 12 is formed by a bottom plate part 12*a* and one pair of crimping strips 12*b* extended from the both sides of the bottom plate part 12*a*. A leading end part of the inner housing 34 is inserted into the inner housing containing cylinder part 11, and thereby the inner housing 34 is mounted on the bottom plate part 12*a* of the inner housing crimp part 12 and the one pair of crimping strips 12*b* is swaged and crimped to the inner housing 34 in this mounting state. Thus, the inner housing 34 is fixed to the body part 2 of the terminal fitting 1 (see FIG. 4). An insertion opening (not illustrated) is formed in a leading end face of the inner housing 34 and a mating terminal (not illustrated) is inserted into the insertion opening of the inner housing 34, and thereby electrically connected with the core wire of the coaxial wire 30.

The crimp part 3 of the terminal fitting 1 is formed by disposing an insulating outer cover crimp part 15 and a braided wire crimp part 17 in a length-wise direction. In this case, the braided wire crimp part 17 is disposed being sandwiched between the inner housing crimp part 12 and the insulating outer cover crimp part 15.

The braided wire crimp part 17 is formed by a braided wire bottom plate part 17*a* which is continuous with the bottom plate part 12*a* of the inner housing crimp part 12 and one pair of braided wire crimp strips 17*b* and 17*c* extended from the both sides of the braided wire bottom plate part 17*a*. The one pair of braided wire crimp strips 17*b* and 17*c* is disposed to stand upright from the both sides of the braided wire bottom plate part 17*a* by being subjected to folding as illustrated in FIG. 1. In the following, in this embodiment, the braided wire crimp strip 17*b* which is situated on the right side in FIG. 2 will be described as a first braided wire crimp strip 17*b* (or one braided wire crimp strip 17*b*) and the braided wire crimp strip 17*c* which is situated on the left side in FIG. 2 will be described as a second braided wire crimp strip 17*c* (or the other braided wire crimp strip 17*c*) in the one pair of braided wire crimp strips 17*b* and 17*c*.

The insulating outer cover crimp part 15 is formed by an insulating outer cover bottom plate part 15*a* which is continuous with the braided wire bottom plate part 17*a* of the braided wire crimp part 17 and one pair of insulating outer cover crimp strips 15*b* and 15*c* extended from the both sides of the insulating outer cover bottom plate part 15*a*. The insulating outer cover crimp strips 15*b* and 15*c* are disposed to stand upright from the both sides of the insulating outer cover bottom plate part 15*a* by being subjected to folding as illustrated in FIG. 1. In the following, in this embodiment, the insulating outer cover crimp strip 15*b* which is situated on the right side in FIG. 2 will be described as a first insulating outer cover crimp strip 15*b* (or one insulating outer cover crimp strip 15*b*) and the insulating outer cover crimp strip 15*c* which is situated on the left side in FIG. 2 will be described as a second insulating outer cover crimp strip 15*c* (or the other insulating outer cover crimp strip 15*c*).

In this embodiment, round hole type serration parts which include round holes are formed for the insulating outer cover crimp part 15 and the braided wire crimp part 17. In the insulating outer cover crimp part 15, a bottom plate side round hole type serration part 18 is formed for the insulating outer cover bottom plate part 15*a*, and a crimp strip side round hole type serration part 19 is formed for the first insulating outer cover crimp strip 15*b* (one insulating outer cover crimp strip 15*b*). Here, no round hole type serration part is formed for the second insulating outer cover crimp strip 15*c* (the other insulating outer cover crimp strip 15*c*).

In the braided wire crimp part 17, a bottom plate side round hole type serration part 22 is formed for the braided wire bottom plate part 17*a* and a crimp strip side round hole type serration part 23 is formed for the second braided wire crimp strip 17*c* (the other braided wire crimp strip 17*c*). In the braided wire crimp part 17, no round hole type serration part is formed for the first braided wire crimp strip 17*b* (one braided wire crimp strip 17*b*).

The respective round hole type serration parts 18, 19, 22 and 23 are formed by arranging round through-holes 18*a*, 19*a*, 22*a* and 23*a* sideways two by two. In the round hole type serration parts 18, 19, 22 and 23 thus formed by the round through-holes, edge parts are lengthened because the braided wire 32 and the insulating outer cover 33 bite into the holes and hence it is possible to increase the fixing strength. In addition, as described above, since parts where the round hole type serration parts 18, 19, 22 and 23 are formed for the insulating outer cover crimp part 15 and the braided wire crimp part 17 are limited, it is possible to suppress a reduction in strength of the insulating outer cover crimp part 15 and the braided wire crimp part 17.

Next, procedures of connecting the terminal fitting 1 according to this embodiment to the coaxial wire 30 will be described. FIG. 3 illustrates a state before the coaxial wire 30 with the inner housing 34 attached is crimped, in which the inner housing 34 is inserted into the inner housing containing cylinder part 11 of the terminal fitting 1. In this state, the braided wire 32 of the coaxial wire 30 is situated so as to correspond to the braided wire crimp part 17 and the insulating outer cover 33 of the coaxial wire 30 is situated so as to correspond to the insulating outer cover crimp part 15. In addition, the inner housing 34 is situated so as to correspond to the inner housing crimp part 12.

FIG. 4 and FIG. 5 illustrate states of performing crimping from above and from below using a crimping jig (not illustrated) which includes an anvil and a crimper in the state of FIG. 3. In the crimping, the inner housing 34 is crimped by the crimping strip 12*b* of the inner housing crimp part 12 on the side of the body part 2 of the terminal fitting 1.

In the insulating outer cover crimp part 15, crimping is performed such that the paired insulating outer cover crimp strips 15*b* and 15*c* are brought into an overlapping state. The same thing also applies to the braided wire crimp part 17. Crimping is performed such that the paired braided wire crimp strips 17*b* and 17*c* are brought into the overlapping state. In the crimping, control is performed such that an overlapping state that the crimp strip with the round hole type serration part formed is situated on the lower side is obtained. That is, in the insulating outer cover crimp part 15, the overlapping state where the first insulating outer cover crimp strip 15*b* (one insulating outer cover crimp strip 15*b*) with the round hole type serration part 19 formed is situated on the lower side and the second insulating outer cover crimp strip 15*c* (the other insulating outer cover crimp strip 15*c*) with no round hole type serration part formed is situated on the upper side is established as illustrated in FIG. 7. On the other hand, in the braided wire crimp part 17, the overlapping state where the second braided wire crimp strip 17*c* (the other braided wire crimp strip 17*c*) with the round hole type serration part 23 formed is situated on the lower side and the first braided wire crimp strip 17*b* (one braided wire crimp strip 17*b*) with no round hole type serration part formed is situated on the upper side is established as illustrated in FIG. 6. In such a crimping structure, since the insulating outer cover 33 and the braided wire 32 bite into all the round hole type serration parts 18, 19, 22 and 23 which are formed for the insulating outer cover crimp part 15 and the braided wire crimp part 17, it is possible to increase the strength of holding the coaxial wire 30.

In such embodiment, since the bottom plate side round hole type serration part 18 is formed for the insulating outer cover bottom plate part 15*a* of the insulating outer cover crimp part 15, the crimp strip side round hole type serration part 19 is formed for the first insulating outer cover crimp strip 15*b*, and the insulating outer cover bottom plate part 15*a* and the first insulating outer cover crimp strip 15*b* are crimped to the insulating outer cover 33 of the coaxial wire 30 from above and from below, the insulating outer cover 33 bites into the round through-holes 18*a* and 19*a* in the round hole type serration parts 18 and 19 which are formed for the part 15*a* and the strip 15*b*. Thus, edge parts of the insulating outer cover 33 which bite into the serration parts are lengthened and hence it is possible to increase the strength of fixing the insulating outer cover 33.

In addition, since the bottom plate side round hole type serration part 22 is formed for the braided wire bottom plate part 17*a* of the braided wire crimp part 17, the crimp strip side round hole type serration part 23 is formed for the second braided wire crimp strip 17*c*, and the braided wire bottom plate part 17*a* and the second braided wire crimp strip 17*c* are crimped to the braided wire 32 of the coaxial wire 30 from above and from below, the braided wire 32 bites into the round through-holes 22*a* and 23*a* in the round hole type serration parts 22 and 23 which are formed for the part 15*a* and the strip 15*c*. Thus, edge parts of the braided wire 32 which bite into the serration parts are also lengthened and hence it is possible to increase the strength of fixing the braided wire 32. Therefore, the strength of holding the coaxial wire 30 is increased, which makes it possible to stably connect the terminal fitting 1 to the coaxial wire 30.

In addition, since the strength of holding the coaxial wire 30 is increased as mentioned above, it is not required to increase the crimping strength more than necessary in crimping the insulating outer cover crimp part 15 and the braided wire crimp part 17 and the core wire of the coaxial wire 30 is not compressed more than necessary. Therefore, it is possible to prevent the core wire from being disconnected.

Further, in this embodiment, since an overlapping direction of the one pair of insulating outer cover crimp strips 15*b* and 15*c* of the insulating outer cover crimp part 15 is opposite to an overlapping direction of the one pair of braided wire crimp strips 17*b* and 17*c* of the braided wire crimp part 17 as illustrated in FIG. 6 and FIG. 7, no rolling occurs in crimping and the position of the terminal fitting 1 relative to the crimping jig is stabilized. Thus, no buckling occurs in the insulating outer cover crimp part 15 and the braided wire crimp part 17.

In addition, in the insulating outer cover crimp part 15, the insulating outer cover bottom plate part 15*a* with the bottom plate side round hole type serration part 18 formed and the first insulating outer cover crimp strip 15*b* with the crimp strip side round hole type serration part formed are crimped in a state of sandwiching the insulating outer cover 33. In the braided wire crimp part 17, the braided wire bottom plate part 17*a* with the bottom plate side round hole type serration part 22 formed and the second braided wire crimp strip 17*c* with the crimp strip side round hole type serration part 23 formed are crimped in a state of sandwiching the braided wire 32. Therefore, no buckling occurs in both of the insulating outer cover crimp part 15 and the braided wire crimp part 17. Since no buckling occurs as mentioned above, it is possible to surely hold the coaxial wire 30.

Figure 8:
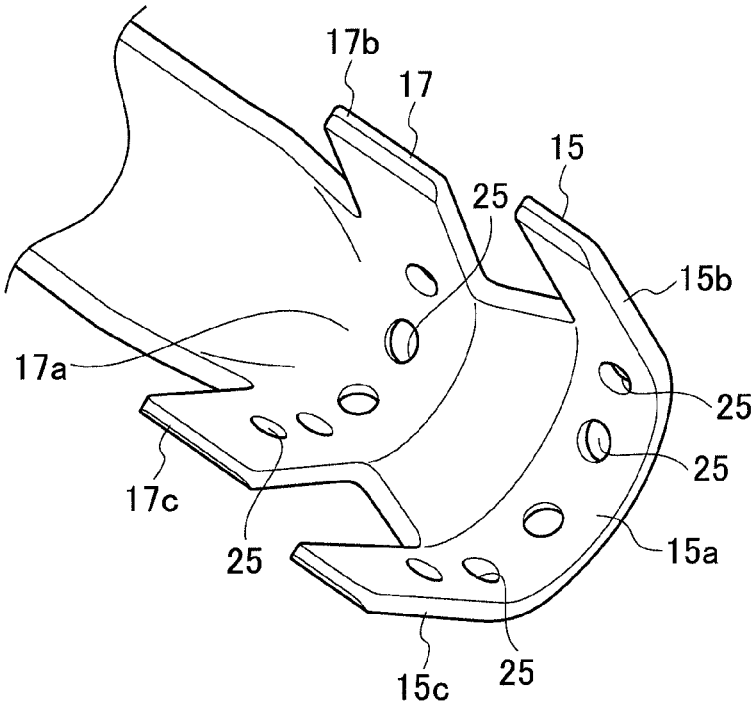
FIG. 8 is a perspective view illustrating a comparative example with respect to one embodiment of the present invention.
Figure 9:
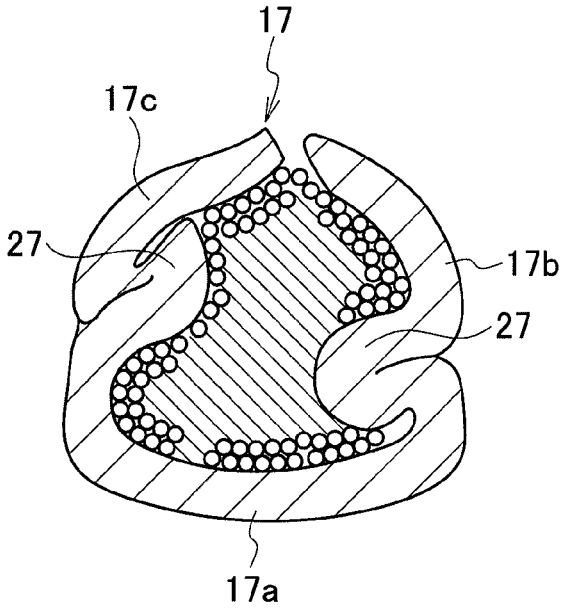
FIG. 9 is a sectional view illustrating buckling occurred when the comparative example is crimped.
Figure 10:
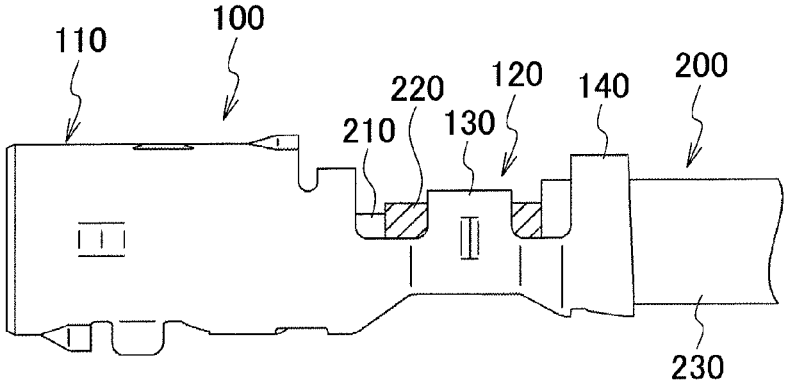
FIG. 10 is a side view illustrating a state where an existing terminal fitting is connected to a coaxial wire.
Figure 11:
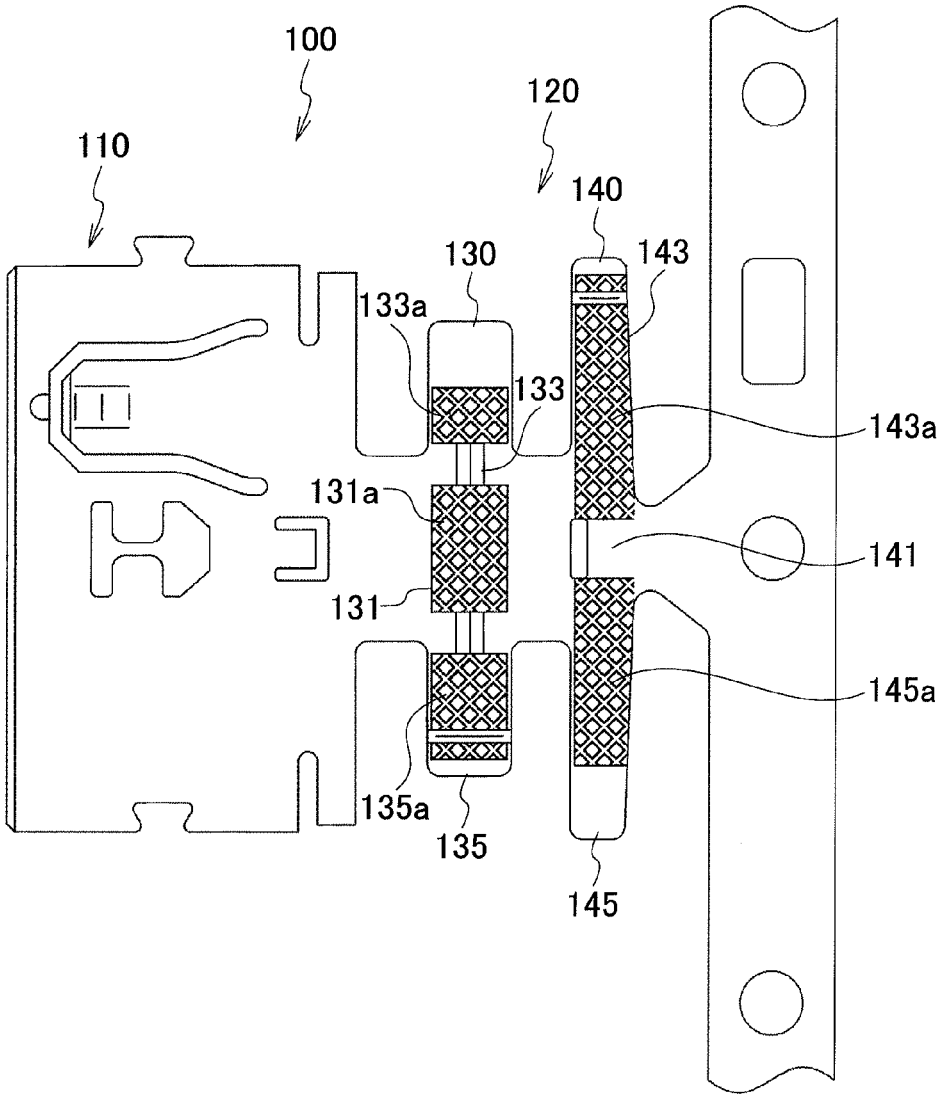
FIG. 11 is a plan view illustrating a development state of the existing terminal fitting.

In addition, since parts where the round hole type serration parts 18, 19, 22 and 23 are formed for the insulating outer cover crimp part 15 and the braided wire crimp part 17 are limited, it is possible to suppress a reduction in strength of the insulating outer cover crimp part 15 and the braided wire crimp part 17. FIG. 8 illustrates a comparative example in which the number of round hole type serration parts 25 which are formed for the insulating outer cover crimp part 15 and the braided wire crimp part 17 is increased. The round hole type serration parts 25 are formed for the insulating outer cover bottom plate part 15*a* and the one pair of insulating outer cover crimp strips 15*b* and 15*c* of the insulating outer cover crimp part 15, and the round hole type serration parts 25 are also formed for the braided wire bottom plate part 17*a* and the one pair of braided wire crimp strips 17*b* and 17*c* of the braided wire crimp part 17. When the number of round hole type serration parts formed is increased as described above, the strength of the insulating outer cover crimp part 15 and the braided wire crimp part 17 becomes weak. Therefore, buckling occurs in the insulating outer cover crimp part 15 and the braided wire crimp part 17 in crimping. FIG. 9 illustrates a sectional view of a part of the braided wire crimp part 17 when the terminal fitting 1 having a structure of FIG. 8 is crimped, buckling 27 undoubtedly occurs in the braided wire crimp part 17.

In the present embodiment, as illustrated in FIG. 2, the round hole type serration parts 18 and 19 are formed for the insulating outer cover bottom plate part 15*a* and the first insulating outer cover crimp strip 15*b* of the insulating outer cover crimp part 15, and no round hole type serration part is formed for the second insulating outer cover crimp strip 15*c*. In addition, the round hole type serration parts 22 and 23 are formed for the braided wire bottom plate part 17*a* and the second braided wire crimp strip 17*c* of the braided wire crimp part 17, and no round hole type serration part is formed for the first braided wire crimp strip 17*b*. Since the parts where the round hole type serration parts 18, 19, 22 and 23 are formed are limited as described above, it is possible to suppress a reduction in strength of the insulating outer cover crimp part 15 and the braided wire crimp part 17, which makes it possible to suppress occurrence of buckling.

The present application claims priority based on Japanese Patent Application No. 2012-044547, filed on Feb. 29, 2012, the content of which is hereby incorporated by reference into this application.

In the terminal fitting according to the present invention, since the round hole type serration parts which include the round holes are formed for the insulating outer cover bottom plate part of the insulating outer cover crimp part and for the braided wire bottom plate part of the braided wire crimp part, the round hole type serration parts which include the round holes are formed for any one of the insulating outer cover crimp strips of the insulating outer cover crimp part and for any one of the braided wire crimp strips of the braided wire crimp part, and the insulating outer cover and the braided wire of the coaxial wire bite into the round hole type serration parts, the edge parts of the insulating outer cover and the braided wire which bite into the round hole type serration parts are lengthened to increase the strength of fixing the insulating outer cover and the braided wire. Thus, it is possible to increase the strength of holding the coaxial wire.

In addition, since the strength of holding the coaxial wire is increased as mentioned above, it is not required to increase the crimping strength more than necessary when crimping the insulated outer cover crimp part and the braided wire crimp part and the core wire of the coaxial wire is not compressed more than necessary. Therefore, it is possible to prevent the core wire from being disconnected.

In addition, since the parts where the round hole type serration parts are formed for the terminal fitting are limited, it is possible to suppress a reduction in strength of the insulating outer cover crimp part and the braided wire crimp part, thereby avoiding occurrence of buckling in these crimp parts.

Further, since crimping is performed in a state where one insulating outer cover crimp strip with the round hole type serration part formed is situated under the other insulating outer cover crimp strip and the other braided wire crimp strip with the round hole type serration part formed is situated under one braided wire crimp strip, the insulating outer cover is allowed to bite into all the round hole type serration parts which are formed for the insulating outer cover crimp part and the braided wire is allowed to bite into all the round hole type serration parts which are formed for the braided wire crimp part. Thus, it is possible to increase the strength of holding the coaxial wire.

DESCRIPTION OF REFERENCE NUMERALS OR SYMBOLS

1: terminal fitting
2: body part
3: crimp part
15: insulating outer cover crimp part
15*a*: insulating outer cover bottom plate part
15*b*: one insulating outer cover crimp strip (first insulating outer cover crimp strip)
15*c*: the other insulating outer cover crimp strip (second insulating outer cover crimp strip)
17: braided wire crimp part
17*a*: braided wire bottom plate part
17*b*: one braided wire crimp strip (first braided wire crimp strip)
17*c*: the other braided wire crimp strip (second braided wire crimp strip)
18, 19, 22, 23: round hole type serration part
30: coaxial wire
32: braided wire
33: insulating outer cover.

What is claimed is:

1. A terminal fitting to which a terminal of a coaxial wire that includes a core wire, a braided wire covering an outer periphery of the core wire via an insulating inner cover and an insulating outer cover covering an outer periphery of the braided wire is to be connected, wherein a body part to be connected to a mating terminal is formed integrally with a crimp part to which the coaxial wire is to be crimped in a state where the insulating outer cover is peeled, the crimp part is formed by an insulating outer cover crimp part to which the insulating outer cover is to be crimped and a braided wire crimp part to which the braided wire is to be crimped, the insulating outer cover crimp part is formed by an insulating outer cover bottom plate part and one pair of insulating outer cover crimp strips extended from the both sides of the insulating outer cover bottom plate part in the same direction, the braided wire crimp part is formed by a braided wire bottom plate part and one pair of braided wire crimp strips extended from the both sides of the braided wire bottom plate part in the same direction, round hole type serration parts which include round holes are formed for the insulating outer cover bottom plate part and for the braided wire bottom plate part, and round hole type serration parts which include round holes are formed for any one of the one pair of insulating outer cover crimp strips and for any one of the one pair of braided wire crimp strips, wherein the round hole type serration part is formed for one of the pair of insulating outer cover crimp strips, and is not formed for the other of insulating outer cover crimp strips, the round hole serration is not formed for one of the pair of braided wire crimp strips, and is formed for the other of the one pair of braided wire crimp strips, one of the one pair of insulating outer cover crimp strips is opposite to the other of the one pair of braided wire crimp strips in relation to bottom plate parts, and crimping is performed in a state where the one insulating outer cover crimp strip with the round hole type serration part formed is situated under the other insulating outer cover crimp strip and the other braided wire crimp strip with the round hold type serration part formed is situated under the one braided wire crimp strip.

* * * * *